United States Patent [19]

Constantinescu

[11] Patent Number: 4,553,494

[45] Date of Patent: Nov. 19, 1985

[54] AQUATIC CAMERA

[76] Inventor: Spiridon Constantinescu, 30 Golders Green Ave., Scarborough, Ontario, Canada, M1C 3P6

[21] Appl. No.: 578,747

[22] Filed: Feb. 9, 1984

[51] Int. Cl.[4] ..... B63B 35/00

[52] U.S. Cl. ..... 114/66; 441/135; 354/76

[58] Field of Search ..... 441/135; 114/66, 343; 354/64, 76

[56] References Cited

U.S. PATENT DOCUMENTS

| | | | |
|---|---|---|---|
| 756,244 | 4/1904 | Larson | 114/66 |
| 1,149,678 | 8/1915 | Parker | 114/66 |
| 1,763,464 | 6/1930 | Gunderson et al. | 114/66 |
| 2,001,682 | 5/1935 | Jackman | 114/66 |
| 4,228,751 | 10/1980 | Robertson et al. | 441/135 |
| 4,465,468 | 8/1984 | Deacy | 441/135 |

FOREIGN PATENT DOCUMENTS

| | | | |
|---|---|---|---|
| 1103172 | 3/1961 | Fed. Rep. of Germany | 441/135 |

*Primary Examiner*—Trygve M. Blix
*Assistant Examiner*—Stephen P. Avila

[57] ABSTRACT

An aquatic camera apparatus consisting of a transparent screen separating an upper dark dry chamber from a lower vacuum wet chamber. The upper dark chamber is provided with a folding camera obscura and a looking mask for the viewer. A drainage valve is provided over the transparent screen for cleaning it and a vacuum valve is provided on top of the wet chamber expelling the air from inside. The device can be used manually or mechanically, outboard or inboard from any watercraft for the purpose of searching the flora and fauna inside any body of clear water. The device can be also used as a direct fishing aid, or for taking underwater photographs.

4 Claims, 18 Drawing Figures

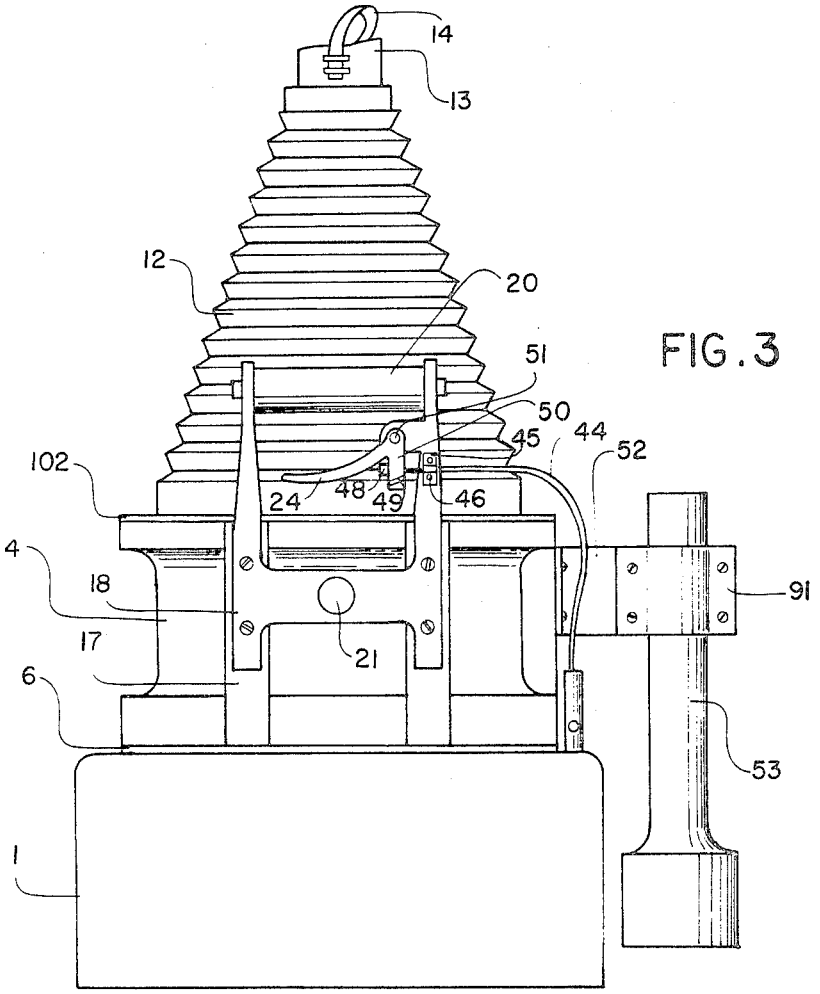
FIG. 3
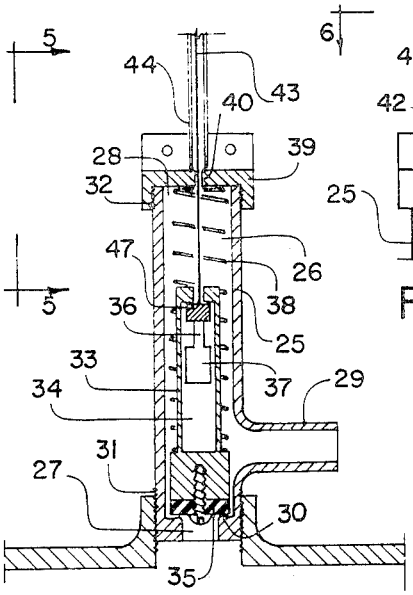
FIG. 4
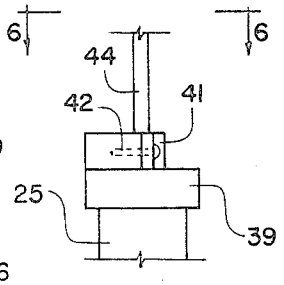
FIG. 5
FIG. 7
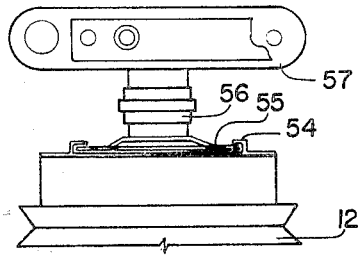
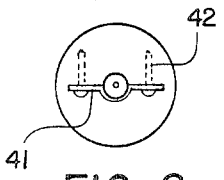
FIG. 6

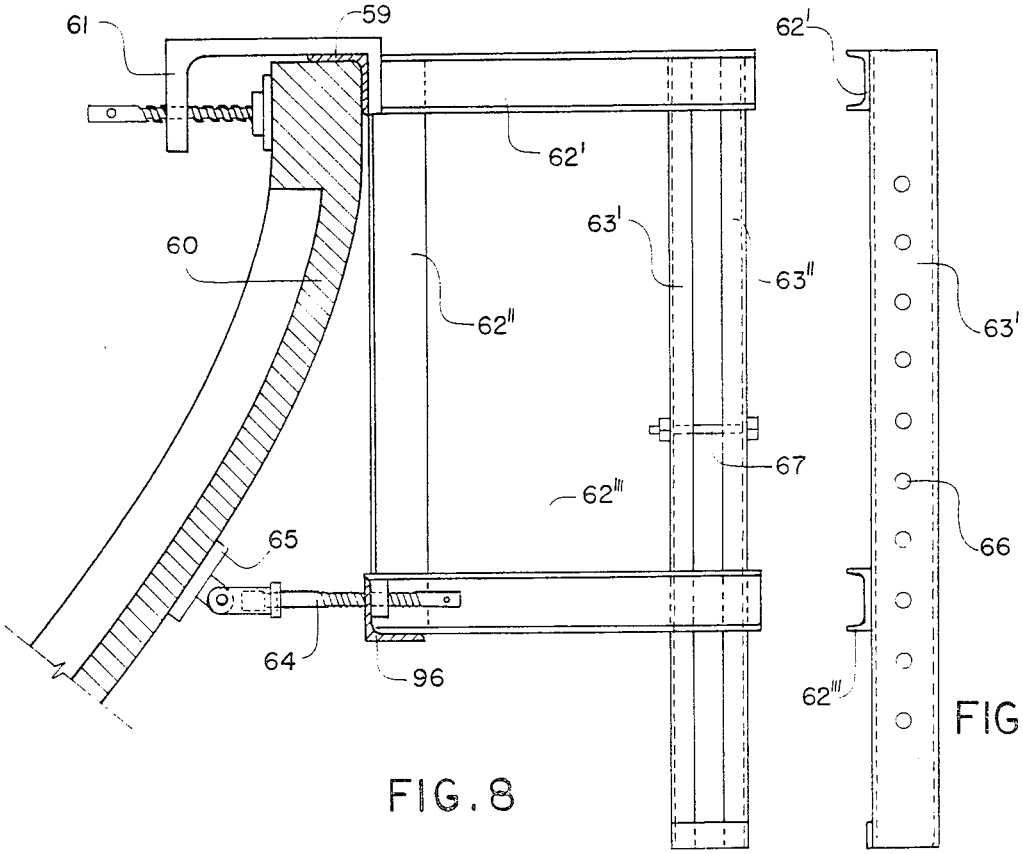
FIG. 8
FIG. 10
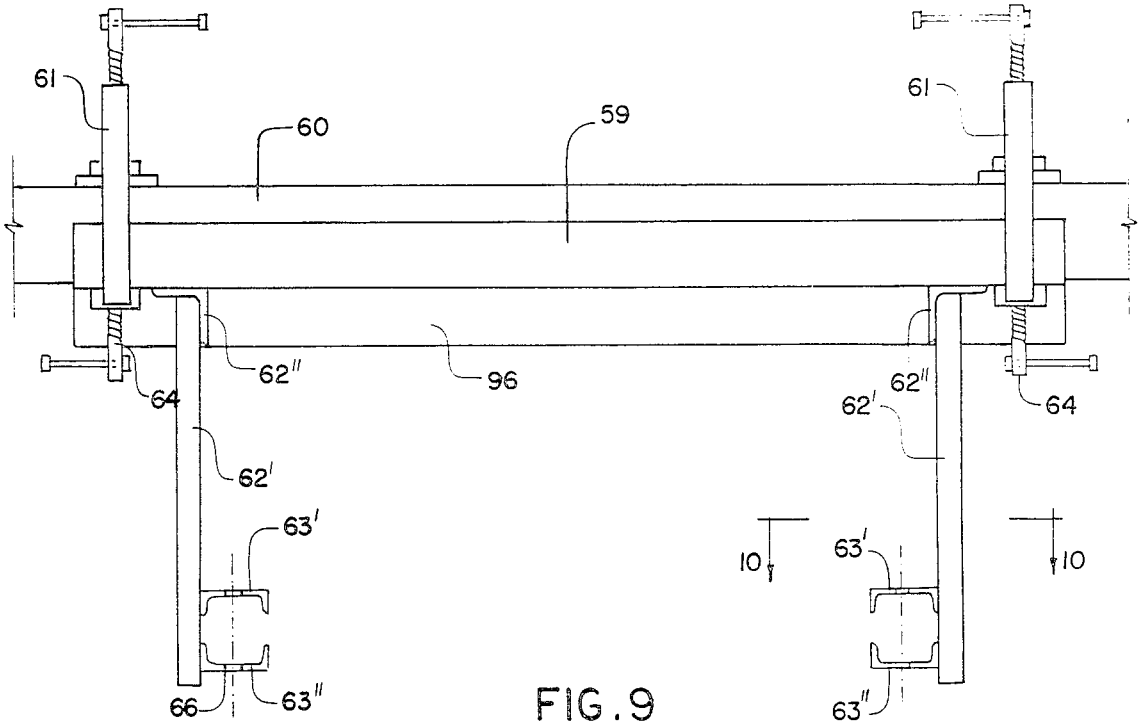
FIG. 9

AQUATIC CAMERA

BACKGROUND OF THE INVENTION

The beauty of underwater flora and fauna is well known. It could be seen on photographs or in the movies. Few swimmers in diving suits can approach the bottom of the water and they can see directly the wonders of the deepness. Boats are floating everywere on the seas, rivers or lakes for different purposes and people could hardly see anything under the water. Even in the case of a very limpid water, a gentle breeze followed by small waves distorts the underwater light beams to such a degree that the surface of the water seems to be a curtain of darkness between us and the deepness. It would be more convenient to look into the water from a watercraft than a hazardously dive into sometimes very cold waters wearing costly outfits and equipments. It is known that one of the fishing tools, Sonar, has electronic sound equipment, which is like having a pair of eyes working for angler beneath the water. The present invention makes it possible for the anglers to look directly into the water within cone angles bigger than Sonar instruments. The aquatic camera excludes the interference of a record interpretation and therefore it is more efficient since the boat could be led accordingly to the spontaneous images seen into the water. Thus, the invention herein relates to an inexpensive looking device which can be manipulated from any boat for a convenient underwater search and for different purposes.

SUMMARY OF THE INVENTION

In accordance with the invention an apparatus for looking into the water from a watercraft is provided; wherein the device is outboard mounted, inboard mounted, or outboard manipulated without any holding system. The apparatus can swing into a plan at right angle to the direction of movement of the boat, therefore covering a big area of the bottom of the water. The images appear on a transparent screen which is in permanent contact with the water having underneath a vacuum wet chamber, therefore eliminating any possibility of waves underneath the screen. The viewer looks into a camera obscura placed above the transparent screen and the images can be improved by using searching lights attached to the apparatus. Also, a camera can be attached to the top of the apparatus for taking underwater photographs.

The principal object of invention is to provide an inexpensive aquatic camera apparatus simply manipulated from a watercraft for looking into the water.

A further object of invention is to provide an apparatus for conveniently underwater searchings for a better knowledge of water fauna and flora.

A further object of invention is to provide a fish finder apparatus looking directly into the water from a watercraft, thus making it possible to efficiently lead the boat over the desired bottom structure or towards the encountered school of fish.

A further object of invention is to provide an apparatus for searching sunk objects by looking directly underwater from a watercraft, therefore covering a larger area than through diving.

A further object of the invention is to provide an apparatus which makes it possible to conveniently search into the water in winter time or into very cold waters where the divers barely operate.

A further object of the invention is to provide an apparatus which allows for taking underwater photographs from a watercraft.

DESCRIPTION OF THE DRAWINGS

FIG. 3 is a side elevation view illustrating the short side of apparatus having attached a flashlight.

FIG. 4 is a sectional view along a longitudinal plane of a valve used either for vacuum or for drainage.

FIG. 5 is a side elevation as shown by line 5—5 in FIG. 4.

FIG. 6 is a plan view as shown by line 6—6 in FIG. 5.

FIG. 7 is a lateral view of the upper end of a dark dry chamber adapted to receive a camera.

FIG. 8 is a vertical axial cross section of the outboard framework for supporting the apparatus.

FIG. 9 is a plan view of the outboard framework.

FIG. 10 is a sectional view taken along line 10—10 of FIG. 9 showing a channel.

DESCRIPTION OF INVENTION

Figure 1:
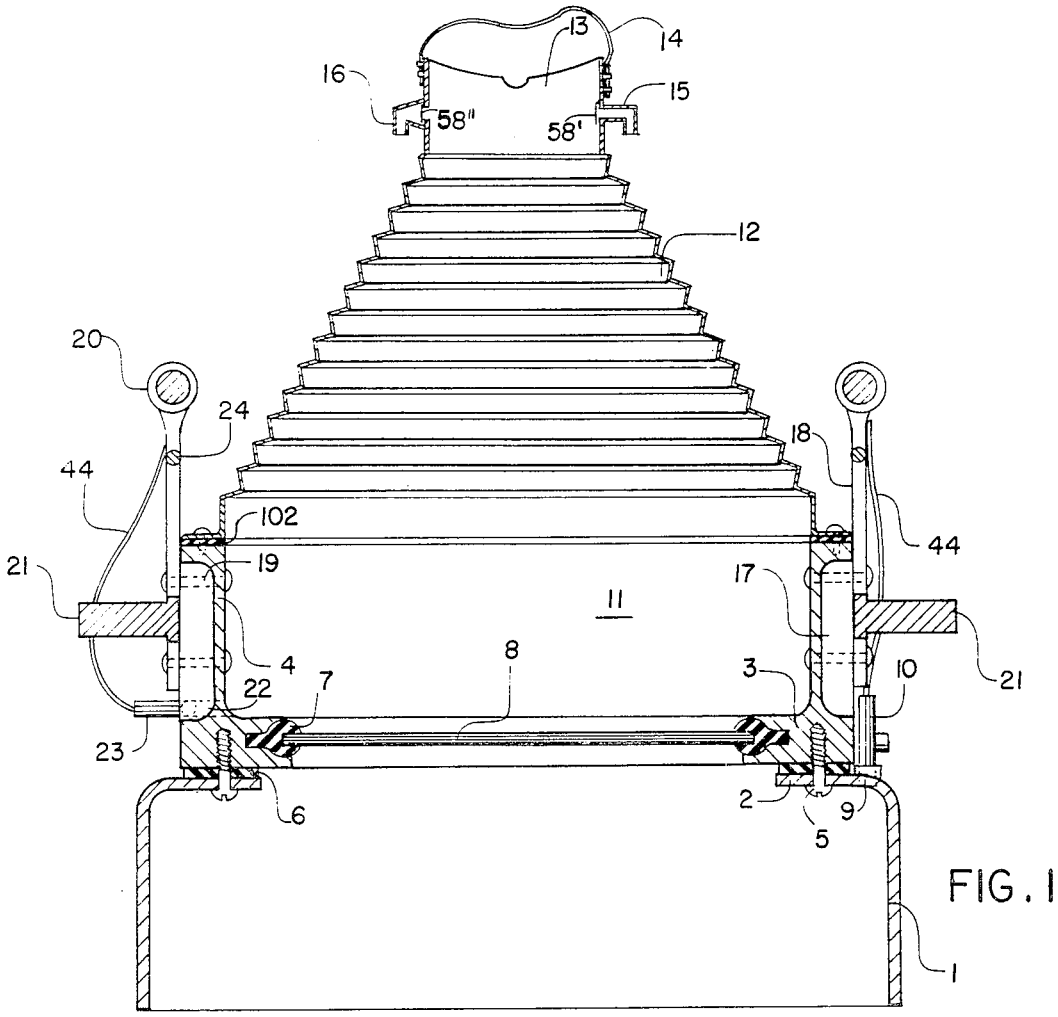
FIG. 1 is a vertical sectional view along a longitudinal plane of an aquatic camera, showing the apparatus of the present invention.
Figure 2:
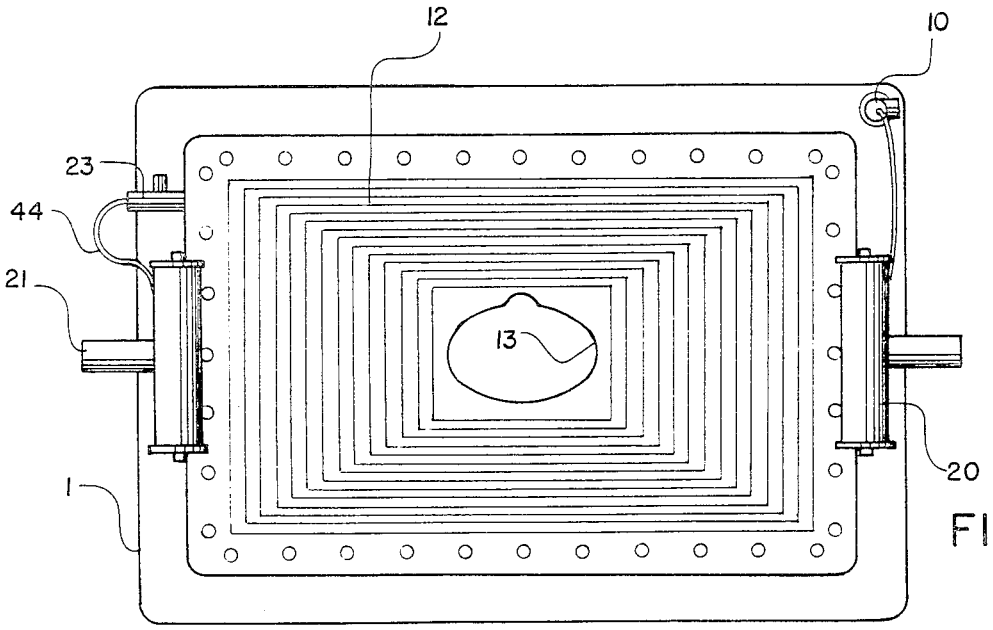
FIG. 2 is a plan view of the apparatus shown in FIG. 1.

Referring now more particularly to the drawings and FIGS. 1, 2, and 3, thereof, one form of aquatic camera is illustrated.

Figure 11:
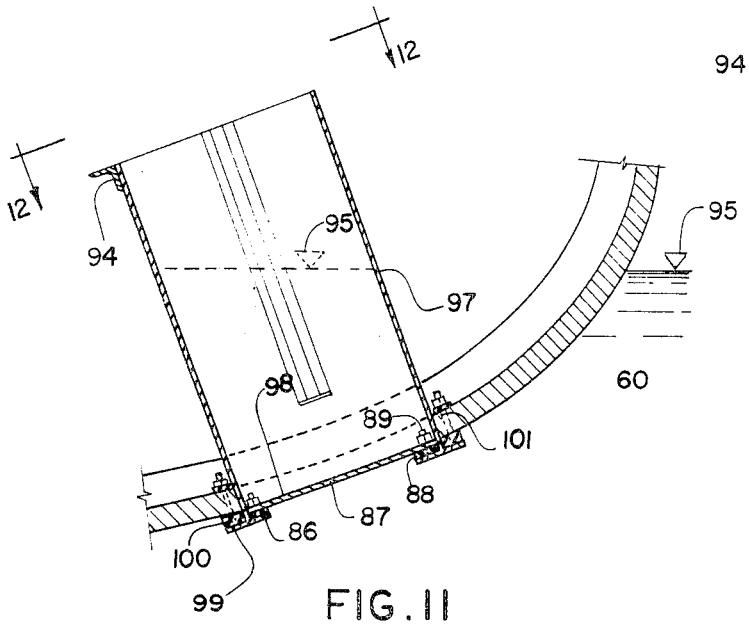
FIG. 11 is a transversal view illustrating an inboard casing for supporting the apparatus.
Figure 12:
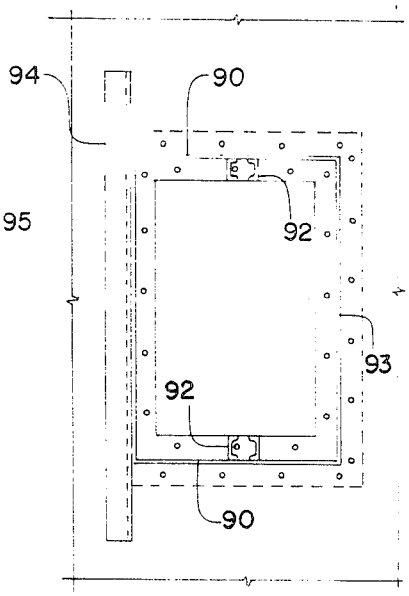
FIG. 12 is a plan view as shown by line 12—12 of FIG. 11.
Figure 13:
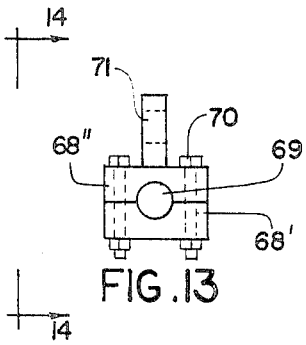
FIG. 13 is a lateral view showing a pair of plates for clasping the spindle of the apparatus.
Figure 14:
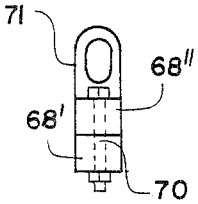
FIG. 14 is a lateral view as shown by line 14—14 of FIG. 13.
Figure 15:
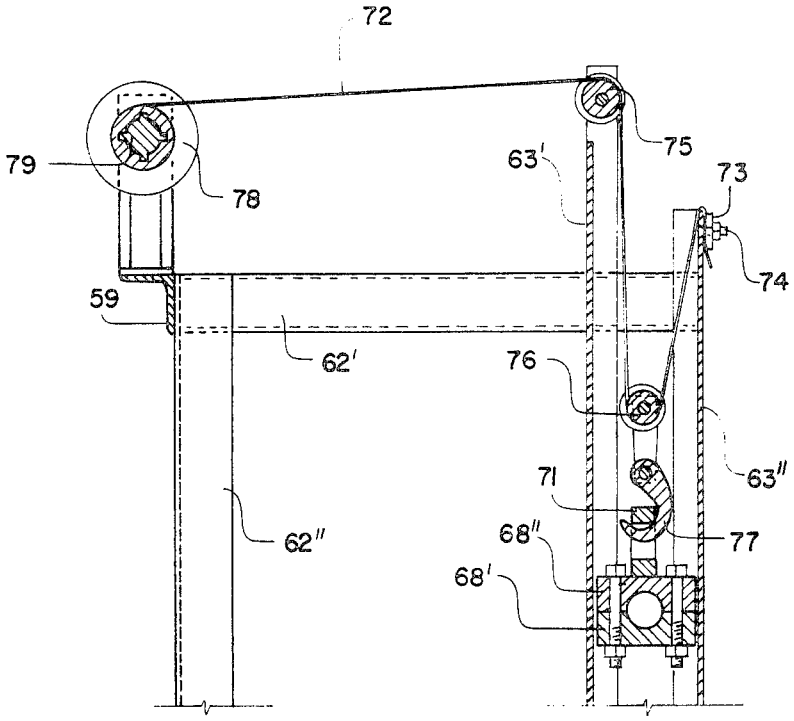
FIG. 15 is a lateral view showing the fixed and runner pulley mechanism hooking one spindle of the apparatus.
Figure 16:
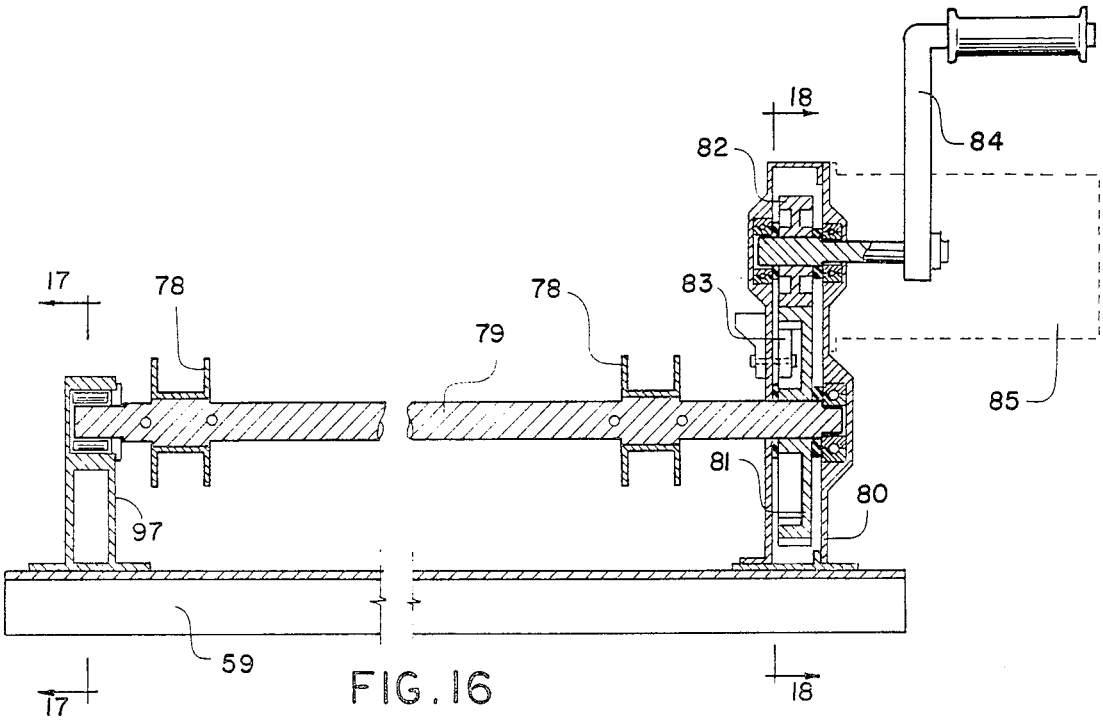
FIG. 16 is an elevation of a hoist mechanism for raising and supporting the apparatus.
Figure 17:
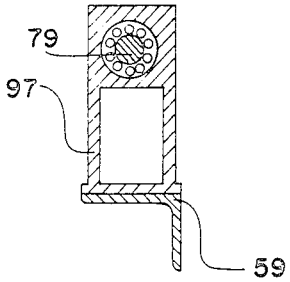
FIG. 17 is a sectional view as shown by line 17—17 of FIG. 16 showing the spur wheels and the stop mechanism.
Figure 18:
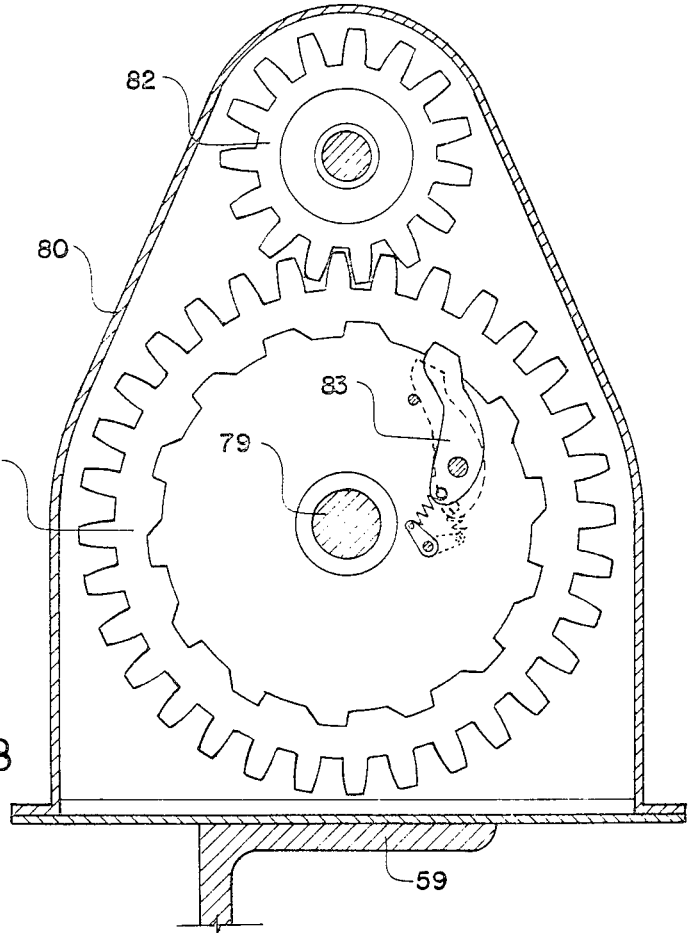
FIG. 18 is a sectional view taken along line 18—18 of FIG. 16.

Casing 1, having a rectangular or elliptical horizontal cross section and having also an open bottom, is for submerging into the water. The upper end of casing 1 is shaped into frame 2 which matches with frame 3 of casing 4. Frame 2 and frame 3 are waterproof joined by screws 5 and elastomeric gasket 6. Frame 3 is inwardly trimmed for receiving elastomeric gasket 7 adapted for mounting transparent screen 8 into a waterproof engagement. Casing 1 has also vacuum hole 9 where is located vacuum valve 10. When casing 1 is sunk in the water, the air from inside casing 1 is expelled through vacuum valve 10 until the level of water reach the lower surface of transparent screen 8. Then, sinking further casing 1 until part of casing 4 is submerged and valve 10 receives from casing 1 water without any air bubbles, valve 10 has to be closed. In this situation casing 1 becomes stuck to the water and also it floats. For a casing 1 having a cross section area of 2 sq. ft. and a depth of 1 ft. it will be necessary a force of approximately 110 lb. to remove casing 1 from the water onto a vertical direction, and for sinking casing 4 with 6" it will be necessary a pressure of approximately 55 lb. minus the weight of the apparatus, which weight is of less importance. That means that when casing 1 is full of water and all air expelled from inside, aquatic camera starts to be in a steady position onto the water. Underneath screen 8 they are not waves because between screen 8 and the water it is not any air, and therefore the light beams from underwater will be not dispersed. On transparent screen 8 the images from beneath the water become visible and the clarity depends on limpidity of the water and on contrast of light between the upper and the lower face of transparent screen 8. For that reason the upper face of screen 8 is incased in dry dark chamber 11. As parts of dark dry chamber 11 they are: casing 4, folding camera obscura 12, elastomeric gasket 102, and lightproof looking mask 13. Strap 14 is for fixing looking mask 13 onto the viewer face. On looking mask 13 they are provided air intake valve 15 and air exhaust valve 16 with their membranes 58' and 58" maintaining permanently inside chamber 11 a total darkness and the surrounding atmospheric pressure which is necessary for a convenient folding of camera obscura 12. As a result folding camera obscura 12 is a lightproof chamber able to change its shape accordingly to the differences in elevations which occur between the water surface and the viewer face. This pliability is mainly necessary when aquatic camera is held directly by the viewer without any other support. Folding camera obscura 12 aids also the viewer to look closer, or further, or at any angle relative to screen 8. Valves 15 and 16 are known means simply equipped with elastic membranes 58' and 58" which allow the air circulation but do not allow the entrance of light beams inside camera obscura 12. The horizontal moving or the swinging of casing 1 into the water does not affect the clearness of images on screen 8 as long as casing 1 is full of water and valve 10 is closed, because between the bottom edge of casing 1 and the mass of water the liquid moves laminary without distorting the beams of light received from underneath. That means that the viewer can search into the water moving aquatic camera in any direction on condition that the bottom edge of casing 1 is maintained under the surface of the water. Casing 1 is reinforced by ribs 17 on which they are fixed brackets 18 by screws 19. Brackets 18 have handles 20 and spindles 21 for manipulating and for supporting the aquatic camera. Casing 4 has drainage hole 22 located above frame 3 tangentially to elastomeric gasket 7. Into drainage hole 22 it is fixed valve 23 which admits water inside dark dry chamber 11 and out of it for cleaning the upper face of transparent screen 8 when it is necessary. The entrance and the exit of this water is realized by holding valve 23 open and moving aquatic camera on vertical and on horizontal conveniently until chamber 11 is again empty, and valve 23 is closed. Valves 10 and 23 are identically built and they are operated by levers 24 mounted on handles 20. Valve 10 or 23 has cylindrical housing 25 which includes axial opening 26, inner end 27, outer end 28, lateral drainage nipple 29, seat 30, thread means 31 and thread means 32. Inside housing 25 are cylindrical valve 33 and compressible spring 38. Cylindrical valve 33 includes axial opening 34, sealing means 35, slot 37 and slit 36. Thread means 31 are for fixing and sealing the valve either into vacuum hole 9, or into drainage hole 22, and thread means 32 receives lid 39 which lid has hole 40 and plate 41 with screws 42. Cable 43 incased in flexible tube 44 makes the connection between valve 33 and lever 24. Flexible tube 44 is fixed to lid 39 by plate 41 and screws 42, and it is fixed also to bracket 18 by plate 45 and screws 46. One end of cable 43 with node 47 passes through slot 37 and through slit 36 of cylindrical valve 33, and the other end of cable 43 with node 48 passes through slit 49 provided in spur 50 of lever 24 which lever can rotate around bolt 51 fixed on bracket 18. When aquatic camera is held by handles 20, the two valve assemblies allow the viewer to operate vacuum valve 10 and drainage valve 23 by activating corresponding lever 24 of each valve. Brace 52 and clamp 91 support flashlight 53 which is provided for improving the images on transparent screen 8 particularly in a gloomy day or in a late evening or even by night. In FIG. 7 it is shown an alternative where the upper end of a dark dry chamber is adapted to receive a camera for taking underwater photographs. Folding camera obscura 12 has on its upper end grooves 54 which receive sliding adaptor 55 fixed to objective 56 of camera 57. Then, flashlight 53 has to be used in connection with camera 57 for providing additional light as usual. In this alternative opaque looking mask has a similar adaptor 55 to be mounted on the same folding camera 12. The dimensions of aquatic camera can be different and they depend mainly on the watercraft. Two main parts give the dimensions of apparatus: the area of transparent screen 8, and the depth of casing 1. The area of transparent screen 8 is related to the area to be sighted under water and the depth of casing 1 is related to the height of the hull of the watercraft. Aquatic camera can be used in different manners. On a dinghy, it can be used outboard manually without any other support. On a big boat, it can be used outboard using a framework for supporting the apparatus. The framework can be equipped with a hoist mechanism for supporting and raising purposes. Aquatic camera can be used also inboard, being supported by a casing which is mounted on the hull. The inboard casing can be also equipped with a hoist mechanism. In FIG. 8 angle 59 is clamped to hull 60 by means of vises 61. Cantilevers 62', 62" and 62''' are perpendicularly solid connected to angle 59 as in FIG. 8 and they are extended outboard up to the two pairs of parallel inwardly facing channels 63'and 63". Cantilevers 62" and 62''' are downwardly supported against hull 60 by angle 96 and two adjustable supports 64 with their articulated plates 65. Channels 63' and 63" have between them an opening slightly bigger than the diameter of spindle 21. The webs of channels 63' and 63" have equidistant corresponding holes 66. Bolts 67 pass through holes 66 and support spindles 21 of apparatus. For a big boat the depth of casing 1 could be 2 or 3 ft. and then the necessary force to raise aquatic camera could be in a range of 200 lb. to 300 lb. In this case it is necessary to raise and to support the apparatus by means of a hoist mechanism manually or mechanically activated. Plates 68' and 68" (FIG. 12) have circular opening 69 between them slightly bigger than the diameter of spindles 21 and these plates are introduced in the openings of channels 63. Channels 63' and 63" are upwardly extended over cantilevers 62' when a hoist mechanism is required as in FIG. 15. Cable 72, of a fixed and runner pulley mechanism, is attached by plate 73 and two bolts 74 to remote channel 63" and pulley 75 is attached to channel 63'. Pulley 76 has hook 77 which hooks up anchorage link 71. Cable 72 is further fixed to reel 78 which is engaged in a rotatable movement by splined shaft 79. They are two pulley mechanisms, one of each spindle 21 of apparatus and they are two reels 78 engaged by shaft 79. Shaft 79 is attached to angle 59 in rotatable engagement by casing 97 (FIG. 17) and casing 80 (FIG. 16) with their corresponding beerings. Inside casing 80 is a spur gearing having spur wheel 81, spur wheel 82 and stop mechanism 83. Spur gearing encased in casing 80 is activated manually by hand crank 84 or mechanically by an electromotor and its reducing gear encased in casing 85. In FIG. 16 hand cranck 84 is drawn in solid lines and casing 85 in doted lines. It is not necessary to enter into details of bearings, stop mechanism, spur gearing and electromotor with its reducing gear because these are accessible known means for any person skilled in the art. In FIGS. 11 and 12 it is shown a casing for an aquatic camera, which casing is mounted through the hull 60. Casing 97 passes through opening 98 of hull 60. Outward frame 99 with gasket 100 and bolts 101 are means for waterproof attachement of casing 97 to hull 60. Inward frame 86, cover 87 with gasket 88 and welded bolts 89 are means for closing the bottom of casing 97 and therefore opening 98. Channels 92 have the same function as channels 63 and they are placed symmetrically on small faces 90 of casing 97. On the upper edge of a big face 93 it is fixed angle 94 for supporting a hoist mechanism when it is required. The height of casing 97 is determined by the level of the water 95 which must be inside casing 97 within a security limit to protect the boat from flooding when cover 87 is removed.

It should, of course, be understood that the description and drawings herein are illustrative merely and that various modifications and changes can be made in the apparatus disclosed without departing from the spirit of the invention.

What is claimed is:

1. An aquatic camera apparatus for looking into the water from a watercraft, said aquatic camera comprising:

(A) a looking mask being lightproof and including:
  (a) a flexible strap for securing said looking mask upon the viewer face,
  (b) an air intake valve, and
  (c) an air exhaust valve;

(B) a folding camera obscura including:
  (a) groove means provided at the upper end of said folding camera obscura for receiving a sliding adaptor fixed either to said looking mask or to an objective of a camera, and
  (b) a downwardly facing first frame;

(C) a first casing including:
  (a) an upwardly facing second frame matching to said first frame,
  (b) a downwardly facing third frame being perimetrically inwardly trimmed for receiving an elastomeric gasket adapted to receive and to seal a horizontal transparent screen, said transparent screen being waterproof mounted and solidly secured against a downwardly movement relative to said third frame,
  (c) a pair of vertical ribs for each short side of said first casing, which ribs are placed symmetrically outside of said first casing for reinforcing and supporting reasons,
  (d) a bracket for each pair of said ribs, said bracket being fixed to said first casing by screw means and having, for manipulating and supporting reasons, a handle, a spindle and a lever articulated by a fix bolt,
  (e) a horizontal threaded drainage hole located above said third frame and tangentially to said elastomeric gasket, and
  (f) a flashlight attached to said first casing;

(D) a second casing having a cross section of similar shape and bigger area relative to said first casing and including:
  (a) an upwardly facing fourth frame matching to said third frame,
  (b) a vacuum wet chamber,
  (c) a vertical threaded vacuum hole located outside of perimeter of said first casing;

(E) first connection means and sealing means for waterproof joining said first frame to said second frame;

(F) second connecting means and sealing means for waterproof joining said third frame to said fourth frame;

(G) two valves, one of them for drainage being located in said drainage hole, and the second for vacuum being located in said vacuum hole, and each of said two valves including:
  (a) a cylindrical housing having an axial opening therethrough, an inner end, an outer end, a lateral drainage nipple, an internal seat at said inner end, and outside thread means at each end, said inner end being screwed to said aquatic camera into one of said locations,
  (b) an internal cylindrical valve having third sealing means matching with said seat, said internal cylindrical valve having an axial opening inside communicating outside through a slot and a first slit,
  (c) a threaded lid matching with said outer end, said lid having an axial hole and connecting means,
  (d) a compressible spring located between said third sealing means of said internal cylindrical valve and said lid, and receiving inside said internal cylindrical valve,
  (e) an activator having a cable incased in a flexible tube, and said cable having a node at each end, said flexible tube being fixed at one end to said connecting means of said lid and at the other end of said bracket, one of said nodes passing through said slot and said first slit and the second of said nodes passing through a second slit provided in a spur attached to said lever, therefore said cable connecting said internal cylindrical valve to said lever articulated to said bracket.

2. An aquatic camera apparatus as in claim 1 wherein said aquatic camera is supported by an outboard framework attached to a hull of said watercraft, said framework comprising:

(A) an angle for directly attaching said framework to said hull;

(B) two vises for clamping together said angle against said hull;

(C) two cantilever frames being perpendicularly solidly connected to said angle and being located outboard of said watercraft and downwardly to said angle; said cantilever frames having a distance between them for permitting the location and the manipulation of said aquatic camera;

(D) two adjustable supports secured one to each said cantilever frame and extending toward said hull for downwardly supporting said outboard framework;

(E) two pairs of vertical parallel inwardly facing channels being fixed one pair to each outside end of said cantilever frame, a pair of said facing channels having between them an opening slightly bigger than the diameter of said spindle, and the webs of said channels having equidistant corresponding holes;

(F) two bolts for passing through said equidistant corresponding holes for supporting said spindles.

3. An aquatic camera apparatus as in claim 1 wherein said aquatic camera is supported by an inboard mounted box onto a hull of said watercraft and said box passing through said hull, said box comprising:

(A) a third casing having a fifth frame including an outward frame and an inward frame;

(B) third connecting means and sealing means for waterproof attaching said outward frame to said hull;

(C) a cover closing the bottom of said box;

(D) fourth connecting means and sealing means for waterproof attaching said cover to said inward frame;

(E) two pairs of inwardly facing channels being parallel to the upwardly extending edges of said box, and each pair of said channels being placed inside said box and symmetrically to the median of a small face of said box;

(F) a horizontal outwardly extending angle fixed to the upper edge of a long face of said box.

4. An aquatic camera apparatus as in claim 2 or 3 wherein said aquatic camera is raised and supported by means of a hoist mechanism comprising:

(A) a pair of plates, an upper one and a lower one, for each one of said spindles for clasping said spindles in a rotatable movement, said pair of plates having bolt means for joining said pair of plates together, and said upper plate having an anchorage link;

(B) a fixed and runner pulley mechanism for each one of said spindles, said pulley mechanism being attached to said pair of channels and to said anchorage link, and having at least two pulleys and a hoisting cable, said hoisting cable having one end fixed to one of said channels placed remotely from said hull;

(C) a winch geared to a shaft, said shaft being attached to said angle by means of a fourth casing and a fifth casing in a rotatable movement and said shaft engaging two reels; the second end of said hoisting cables being fixed to said reels for winding said hoisting cables; and said winch being activated either manually or mechanically.

* * * * *